US005885440A

United States Patent [19]

Hoehn et al.

[11] Patent Number: 5,885,440

[45] Date of Patent: Mar. 23, 1999

[54] HYDROCRACKING PROCESS WITH INTEGRATED EFFLUENT HYDROTREATING ZONE

[75] Inventors: Richard K. Hoehn, Mt. Prospect; Vasant P. Thakkar, Elk Grove Village; Daniel L. Ellig, Mt. Prospect, all of Ill.

[73] Assignee: UOP LLC, Des Plaines, Ill.

[21] Appl. No.: 918,436

[22] Filed: Aug. 26, 1997

Related U.S. Application Data

[60] Provisional application No. 60/026,871 Oct. 1, 1996.

[51] Int. Cl.[6] ..... C10G 69/02

[52] U.S. Cl. ..... 208/97; 208/108; 208/111; 208/58

[58] Field of Search ..... 208/97, 108, 111, 208/58

[56] References Cited

U.S. PATENT DOCUMENTS

| | | | |
|---|---|---|---|
| 2,987,468 | 6/1961 | Chervenak | 208/97 |
| 3,183,179 | 5/1965 | Schuman | 208/97 |
| 3,291,721 | 12/1966 | Schuman | 208/97 |
| 3,338,819 | 8/1967 | Wood | 208/97 |
| 3,365,388 | 1/1968 | Scott, Jr. | 208/59 |
| 3,472,759 | 10/1969 | Masologites et al. | 208/97 |
| 3,551,323 | 12/1970 | Hamblin | 208/58 |
| 3,716,476 | 2/1973 | Coons, Jr. et al. | 208/97 |
| 4,400,263 | 8/1983 | Kydd et al. | 208/10 |
| 4,457,829 | 7/1984 | Abrams | 208/97 |
| 4,661,239 | 4/1987 | Steigleder | 208/111 |

*Primary Examiner*—Walter D. Griffin
*Attorney, Agent, or Firm*—Thomas K. McBride; John F. Spears, Jr.

[57] ABSTRACT

The invention is a hydrocracking process which employs a small reactor-containing hydrotreating catalyst to reduce the recombinant mercaptan content and/or smoke point of a product recovered from the effluent of the hydrocracking reactor. The entire effluent of the hydrocracking reactor is first cooled by indirect heat exchange and then passed through the hydrotreating catalyst. The effluent of the hydrotreating catalyst then continues throughout the customary cooling and separation steps employed in the product recovery system.

8 Claims, 1 Drawing Sheet

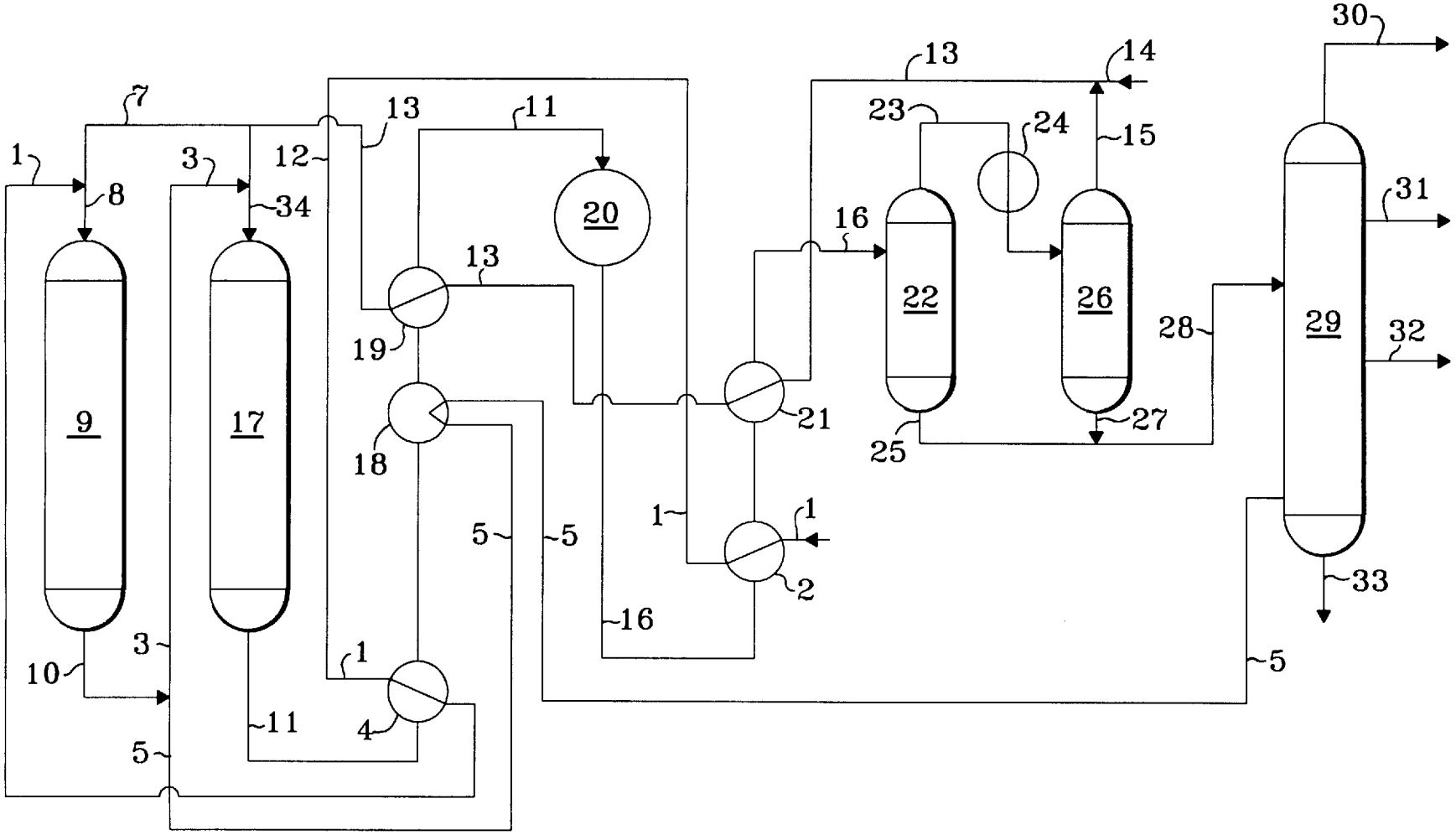
30
31
32
33
29
5
28
14
15
26
27
24
13
23
22
25
16
21
1
2
1
16
20
11
5
13
5
13
19
18
1
4
12
34
17
11
3
3
5
7
8
9
10
1

HYDROCRACKING PROCESS WITH INTEGRATED EFFLUENT HYDROTREATING ZONE

This application is related to and claims the benefit of the filing date of provisional application 60/026,871 filed Oct. 1, 1996.

FIELD OF THE INVENTION

The invention is a hydrocarbon conversion process for hydrocracking petroleum distillates and residual hydrocarbons. The invention relates to improving the quality of hydrocracking unit products by reducing the mercaptan content of a naphtha boiling range fraction recovered from a hydrocracking unit. The invention specifically relates to a hydrocracking process wherein the entire effluent of the hydrocracking reaction zone is subjected to a hydrotreating reaction performed in a separate reactor prior to being cooled and passed into the final vapor-liquid separation and product recovery zone used in the overall hydrocracking process. The subject invention is specifically directed to improving hydrocracking processes which employed a small bed of hydrotreating catalyst in the bottom of the last hydrocracking reactor to reduce the mercaptan content of the recovered gasoline product fraction.

RELATED ART

Hydrocracking processes are well developed and are used commercially in a large number of petroleum refineries for the conversion or upgrading of mixtures of hydrocarbons to more valuable lighter products. Hydrocracking may be employed for the conversion of a wide variety of feedstocks ranging from a light material such as a naphtha to heavy black oils such as vacuum column gas oil and demetallized oils. Hydrocracking is, however, much more often applied to the conversion of a relatively heavy or residual material such as a vacuum gas oil to gasoline or middle distillates including diesel and jet fuels.

A specific example of a hydrocracking process intended for the production of middle distillates is provided in U.S. Pat. No. 4,661,239 issued to K. Z. Steigleder, which is incorporated herein by reference. This reference describes hydrocracking catalysts containing Y zeolites of specific unit cell sizes, typical hydrogenation metals, inorganic oxide matrix materials and operating conditions suitable for use in the subject process.

U.S. Pat. No. 3,338,819 issued to F. C. Wood which is also incorporated herein by reference describes the general problem addressed by the subject invention. This patent describes a combined or integral hydrocracking-hydrotreating process in which a charge stock is passed through a hydrotreating reactor and is then passed into a hydrocracking reactor. A small bed 16 of hydrotreating catalyst is located at the bottom of the hydrocracking reactor to reduce the concentration of mercaptans in the naphtha boiling range product of the hydrocracking process.

U.S. Pat. No. 4,400,263 is directed to an ebulated bed process for converting coal and other hydrocarbonaceous materials into more valuable liquid products. The effluent of the first reactor is passed into a number of separation steps with the lighter phases recovered from this separation being passed into a hydrotreater 20.

U.S. Pat. No. 3,365,388 issued to J. W. Scott illustrates a hydrocarbon conversion process in which a portion of the effluent of the conversion reactor is passed into a downstream catalytic reaction zone 22. In one embodiment this reference teaches that the first reaction zone can operate to hydrocrack the feed material and the second reaction zone will function as a hydrotreating zone.

U.S. Pat. No. 3,551,323 issued to R. J. J. Hamblin describes a hydrocracking process wherein the effluent of the hydrocracking reactor is passed into a hot high pressure separator 9 having a bed of desulfurization catalyst located in the upper portion of the separator.

BRIEF DESCRIPTION OF THE DRAWING

The Drawing is a simplified flow diagram showing use of the invention in a hydrocracking process unit in which the effluent of hydrocracking reactor 17 is cooled in heat exchangers 4, 18 and 19 before entering the post treating reactor 20 prior to any separation of the effluent.

SUMMARY OF THE INVENTION

The invention is an improved hydrocracking process characterized by the use of indirect heat exchange to adjust the temperature of the entire hydrocracking zone effluent prior to post treating the hydrocracking zone effluent. It has been discovered that the "post treating" of the effluent of a hydrocracking reactor can be improved by first cooling the effluent by heat exchange against various feed streams. This improves the performance of the process and eliminates the need to charge quench hydrogen to the hydrocracking reactor above the hydrotreating catalyst, thus reducing the cost of operating the process.

One broad embodiment of the invention is a hydrocracking process in which a feed stream comprising hydrocarbons boiling above the gasoline boiling point range is contacted with a bed of hydrocracking catalyst in a fixed bed hydrocracking reactor operated at hydrocracking conditions to produce a hydrocracking catalyst effluent stream, and the entire hydrocracking catalyst effluent stream is contacted with a smaller second bed of hydrotreating catalyst to reduce the level of mercaptans in naphtha boiling range hydrocarbons recovered from the hydrocracking catalyst effluent stream characterized by the improvement which comprises removing the hydrocracking catalyst effluent stream from the reactor, cooling the entire hydrocracking catalyst effluent stream by indirect heat exchange against the feed stream, passing the hydrocracking catalyst effluent stream into a hydrotreating reactor and producing a hydrotreated reaction zone effluent, cooling the hydrotreated reaction zone effluent stream by indirect heat exchange against a process stream which is subsequently passed into the reactor, and recovering a naphtha boiling range product stream from the hydrotreated reaction zone effluent stream.

DETAILED DESCRIPTION AND EMBODIMENTS

Advances in hydrocracking have resulted in the development of highly active and selective hydrocracking catalysts and effective process flows. Nevertheless, there is always still room for improvement. For instance, reductions in the capital cost of the hydrocracking unit and improvements in the selectivity and activity of a catalyst are always desired. Improvements to the quality of the products, such as diesel fuel by isomerization of "waxy" paraffins, the removal of contaminants by hydrotreating and the saturation of aromatics are also desirable. Another area in which improvements are always sought is the cost of operating the overall process.

As described in previously cited U.S. Pat. No. 3,338,819 it was discovered that olefins are apparently produced in the hydrocracking reaction zone and then combine with the hydrogen sulfide which is also present to form mercaptans. These mercaptans are sometimes referred to as recombinant sulfur compounds. The presence of mercaptans in the hydrocracking zone effluent resulted in the naphtha boiling range product failing sulfur related product specifications, and the naphtha therefore required further treatment increasing the cost of naphtha production. The solution described in this cited patent is the use of a small bed of hydrotreating catalyst, preferably located in the bottom of the hydrocracking reactor, to hydrotreat the mercaptans and olefins.

It has been found that cooling the effluent of the hydrocracking catalyst before it enters this "post treating" catalyst is beneficial in improving the quality of the products and/or increasing the time between required unit shut downs for catalyst regeneration or replacement. Such cooling could be performed using indirect heat exchange within the hydrocracking reactor, but the addition of a direct heat exchange coolant referred to as quench hydrogen is preferred. However, the use of quench hydrogen requires the provision of a distributor/mixer device between the beds of catalyst, which takes up valuable reactor space and increases the size and the weight of the heavy wall pressure used as the vessel reactor.

It is an objective of the subject invention to provide a more economical hydrocracking process useful in converting heavy feeds into distillate products such as naphtha, diesel fuel and jet fuel boiling range products. It is a further objective of the subject invention to provide a more economical process for upgrading distillate fuels produced in a hydrocracking process. A specific objective of the invention is to reduce the cost of post treating the naphtha boiling range product of a hydrocracking reaction zone by eliminating the need for passage of a post treat quench (coolant) stream into the hydrocracking reaction zone.

These objectives are achieved by the use of a separate hydrotreating reaction zone located downstream of the hydrocracking reactor together with selective indirect heat exchange against feed streams to the hydrocracking reactor to adjust the temperature of the reactor effluent. This has several advantages. This system does not require any external coolant to adjust the temperature of the material entering the post treating reactor. Second, the heat removed from the effluent is returned to the feed stream thus lowering the net fuel requirements. Most importantly the system can adjust the temperature of the hydrocracking reactor effluent without the use of quench hydrogen being injected into the hydrocracking zone. This eliminates the costly hydrogen quench and frees up space otherwise used in the hydrocracking reactor for the post treating catalyst and the quench distributor. In a new unit the size of the hydrocracking reactor is decreased. In a revamp to an existing unit more space becomes available for hydrocracking catalyst in the existing reactor.

The ability of the subject process to adjust the temperature of the effluent of the hydrocracking zone is important to achieving good levels of mercaptan removal. The upstream feed preparation hydrotreating zone shown in the drawing is intended to reduce the large amounts of "native" sulfur present in the raw feed stream. In contrast the post treating reactor is intended to reduce the "recombinant" or mercaptan sulfur content of the recovered naphtha to very low levels of less than 5 and preferably less than 1 ppm. Besides this difference, the preferred operating conditions in these two differing types of hydrotreating steps often also differs. A bulk hydrotreater or desulfurizer used to remove native sulfur may operate at 700°–750° F. and a low space velocity below 3.0. In contrast the subject post treating reactor operates at a much lower temperature, preferably 500°–550° F., and a much higher liquid hourly space velocity of at least 10 $hr^{-1}$. These conditions are very ineffective at removing any significant amount of the native sulfur of the raw feed. The temperature difference is even more significant when it is noted that the effluent of a distillate hydrocracking unit will often be above 730° F. and often may be as hot as 770°–780° F. at end-of-run conditions. A naphtha hydrocracking unit, however, may have a cooler effluent temperature of below 600° F. and therefore may not need cooling before entering into the post treating reactor.

Suitable feedstocks for the subject process include virtually any heavy hydrocarbonaceous mineral or synthetic oil and fractions thereof. Thus, such known feedstocks as straight run gas oils, vacuum gas oils, demetallized oils, deasphalted vacuum residue, coker distillates, cat cracker distillates, shale oil, tar sand oil, coal liquids and the like are contemplated. The preferred feedstock will have a boiling point range starting at a temperature above about 260° Celsius (500° F.) and does not contain an appreciable concentration of asphaltenes. The feed stream should have a boiling point range-falling between 260°–538° C. Preferred first stage feedstocks therefore include gas oils having at least 50% volume of their components boiling above 371° C. (700° F.). The hydrocracking feedstock may contain nitrogen, usually present as organonitrogen compounds in amounts between 1 ppm and 1.0 wt. %. The feed will normally also contain sulfur containing compounds sufficient to provide a sulfur content greater than 0.15 wt. %.

Depending on such factors as the composition of the feed and the desired products hydrocracking process units have different configurations and complexities. The hydrocracking process employing the subject invention may employ a single reactor operated in a once-through mode. Alternatively the hydrocracking unit will include a fractionation column(s) which generates a recycle stream containing some or all of the unconverted materials recovered from the effluent of the hydrocracking reactor. The process may employ multiple hydrocracking reactors operated in parallel or in series flow. In the preferred configuration, similar to that shown in the Drawing, the feed is first processed in a hydrotreating reactor to reduce its level of metals, sulfur and nitrogen upstream of the hydrocracking reactor. Another variation in hydrocracking processes is the use of a vapor-liquid separation step and/or gas treating between the hydrotreating reactor and the downstream hydrocracking reactor to reduce the concentration of hydrogen sulfide and ammonia in the materials being charged to the hydrocracking reactor.

The effluent from any upstream hydrotreating reactor will comprise an admixture of hydrocarbons having essentially the same full boiling point range as the feed which enters the hydrotreating reactor as only a small amount, preferably less than 15%, conversion occurs in this zone. That is, the feed to the hydrocracking reactor is normally hydrotreated without significant cracking. Most preferably less than 5% conversion to lower boiling ($C_5$-minus) hydrocarbons occurs in the hydrotreating zone. The conversion which does occur will produce some lower boiling hydrocarbons but the majority of the feed passes through the hydrotreating reactor with only a minor boiling point change.

In a representative example of a conventional hydrocracking process, a heavy gas oil would be charged to the process and admixed with any hydrocarbon recycle stream. The resultant admixture of these two liquid phase streams is heated in an indirect heat exchange means and then combined with a hydrogen-rich recycle gas stream. The admixture of charge hydrocarbons, recycle hydrocarbons and hydrogen is heated in a fired heater and thereby brought up to the desired inlet temperature for the hydrocracking reaction zone. Within the reaction zone the mixture of hydrocarbons and hydrogen are brought into contact with one or more beds of a solid hydrocracking catalyst maintained at hydrocracking conditions. This contacting results in the conversion of a significant portion of the entering hydrocarbons into molecules of lower molecular weight and therefore of lower boiling point.

There is thereby produced a reaction zone effluent stream which comprises an admixture of the remaining hydrogen which is not consumed in the reaction, light hydrocarbons such as methane, ethane, propane, butane, and pentane formed by the cracking of the feed hydrocarbons, reaction by-products such as hydrogen sulfide and ammonia formed by hydrodesulfurization and hydrodenitrification reactions which occur simultaneously with the hydrocracking reaction plus the desired product hydrocarbons boiling in the gasoline, diesel fuel, kerosene or fuel oil boiling point ranges and in addition some unconverted feed hydrocarbons boiling above the boiling point ranges of the desired products. The effluent of the hydrocracking reaction zone will therefore comprise an extremely broad and varied mixture of individual compounds.

The hydrocracking reaction zone effluent is typically removed from contact with the catalyst bed, heat exchanged with the feed to the reaction zone and then passed into a vapor-liquid separation zone normally referred to as a high pressure separator. Additional cooling can be done prior to this separation. In some instances a hot flash separator is used upstream of the high pressure separator. The use of "cold" separators to remove condensate from vapor from a hot separator is another option. The liquid recovered in these vapor-liquid separation zones are passed into product recovery zones containing one or more fractionation columns. Product recovery methods for hydrocracking are well known and conventional methods may be employed. In many instances the conversion achieved in the hydrocracking reactor(s) is not complete and some heavy hydrocarbons may be removed from the product recovery zone as a "drag stream" which is removed from the process or as a recycle stream. The recycle stream is preferably passed into the hydrotreating (first) reactor in a hydrotreating-hydrocracking sequence as this reduces the capital cost of the overall unit. It may, however, sometimes be passed into the hydrocracking (second) reactor as shown in the drawing.

Separation steps which remove some hydrogen sulfide will often be required to maintain the desired hydrogen concentration in the recycle gas and to keep the hydrogen sulfide concentration in an acceptable range. These may be performed on the recycle gas stream. Additional hydrogen sulfide removal can be achieved by stripping or debutanizing internal process streams.

The invention may be readily understood by reference to the Drawing, which illustrates a very simplified process flow diagram for an integrated hydrocracking process. The drawing has been simplified by not showing the many required control systems, flow control mechanisms, vessel internals and some vessels and heat exchangers normally employed in a process unit of this type. In particular, the product recovery scheme illustrated in the Drawing is intended to be representative of the equipment which is actually used and thus does not illustrate all of the vapor-liquid separation zones or fractionation columns normally employed in such a unit. Also not shown for the purpose of clarity are the feed preheaters, reactor quench systems, water injection and recovery systems, bypass lines around heat exchangers to allow for controlling the amount of heat exchange performed and other ancillary equipment not relevant to an illustration of the invention.

The hydrocarbonaceous feed to the hydrocracking unit enters the process through line 1 and is heated in the indirect heat exchanger 2 before continuing through line 1. The feedstream is then further heated in the indirect heat exchange means 4 and admixed with a hydrogen-rich gas stream carried by line 7. As used herein, the term "rich" refers to a molar concentration above 50%, and preferably above 70% of the designated chemical species or class of compounds. The admixture of fresh feed and hydrogen flows through line 8 into a hydrotreating reactor 9. The function of the hydrotreating reactor is to reduce the sulfur and nitrogen content and possibly to remove some of the metals content of the entering feedstock, actions which have been found to be beneficial to the life and performance of the hydrocracking catalyst located in the downstream reactor 17. The mixed-phase effluent of the hydrotreating reactor 9 is transported through line 10 to the junction with line 5. Line 5 carries a stream of recycled hydrocarbons removed from the product fractionation section. The admixture of hydrotreated fresh feed from line 10 and recycle liquid from line 5 flows through line 3 to the junction with line 12 which carries additional hydrogen-rich gas. The admixture of hydrogen, fresh feed and the effluent of the hydrotreating reactor 9 are then passed into the hydrocracking reactor 17 through line 34.

The effluent of the hydrocracking reactor comprises an admixture of residual hydrogen and unconverted hydrocarbons, reaction by-products such as light gases including methane, ethane, and propane and hydrogen sulfide and ammonia and various product hydrocarbons boiling in the naphtha jet fuel and diesel boiling ranges. The product hydrocarbons will include paraffins, olefins and aromatics. This vast spectrum of compounds is transported through line 11 as the hydrocracking zone effluent stream. It is first cooled by indirect heat exchange against at least a portion of the feed stream in the heat exchanger 4 and then continues through line 11 for further cooling in the indirect heat exchange means 18. The entire effluent of the hydrocracking reactor is then further cooled by indirect heat exchange against the recycle hydrogen of line 13 in the exchanger 19 and is finally passed into a small spherical post treat hydrotreating reactor 20. The post treating reactor of the subject process is located between the exit of the last hydrocracking reactor and the initial high pressure separator of the effluent separation chain. This may be the only high pressure separator employed in the process. A high pressure separator operates at essentially the outlet pressure of the conversion reactor except for any inherent pressure drop due to flowing through the interconnecting lines. A "hot" high pressure separator is distinguished in the art from a "cold" high pressure separator by the fact that the process stream entering a cold separator has been cooled by indirect heat exchange against an external coolant stream such as air or cooling water. Some portion of the feed stream, recycle stream and/or recycle hydrogen may bypass exchangers 4, 18 and 19 as controlled by the temperature control system for reactors 9 and 17 or downstream reactor 20.

This post treating reactor serves to hydrogenate various naphtha or gasoline boiling range olefins and mercaptans. As pointed out in the previously cited U.S. Pat. No. 3,338,819 these olefins are apparently formed in the hydrocracking reactor despite the presence of hydrogen and hydrogenation components on the hydrocracking catalyst. Hydrogenation of the olefins reduces the amount of the olefinic hydrocarbons which combine with the available hydrogen sulfide to form additional mercaptans and results in a naphtha boiling range product having a lower mercaptan content. Other molecular species including aromatics in the jet fuel boiling range and polynuclear aromatics (PNAs) may be simultaneously hydrogenated with equally beneficial results. For instance, hydrogenation of aromatics usually tends to improve the smoke point and other product qualities of jet fuels and the hydrogenation of PNAs tends to make them easier to crack in the hydrocracking reactor if they are recycled from the product recovery zone.

The thus hydrotreated entire effluent of the hydrocracking zone then flows into the indirect heat exchange means 2 where it is further cooled by heat exchange against the feed stream. Further cooling in exchanger 21 is followed by passage through line 16 into the high pressure hot separator 22. The high pressure hot separator is designed and operated to separate the entering mixed-phase fluids including the liquid resulting from the cooling in the five preceding heat exchangers plus any liquid phase material which leaves the hydrocracking zone from the material which is in a gas phase at this temperature and pressure. The liquids are removed from the high pressure hot separator through line 25 for passage to the downstream product recovery facilities. The gas phase stream is removed through line 23 and will comprise a sizable quantity of naphtha boiling range materials in addition to light gases such as methane, propane and butane, by-products such as hydrogen sulfide and a large percentage of the hydrogen present in the effluent of the hydrocracking reactor 17. The gas phase stream is passed through a series of coolers represented by the indirect heat exchange means 24 which results in the condensation of a significant quantity of the hydrocarbons present in the vapor. The fluids in line 23 are then passed into the high pressure cold separator 26. The fluids entering the separator 26 are divided into a gas phase stream and a liquid phase removed through line 27 for passage through line 28 into the product recovery zone represented by the fractionation column 29. The gas phase stream of line 15 is admixed with makeup hydrogen from line 14 and passed into line 13 as the recycle gas stream of the process.

A portion of the gas phase stream removed from separator 26 through line 15 may be subjected to further treatments to remove impurities and light hydrocarbons present in this gas stream. These further treatments may include further cooling by indirect heat exchange to effect condensation of additional hydrocarbons and various gas treating steps to remove hydrogen sulfide. The recycle gas stream of line 13 is heated during passage through the indirect heat exchange means 21 and 19. It is then admixed via lines 7 and 12 with the hydrocarbon process streams entering reactors 9 and 17 respectively.

The liquids recovered from the effluent of the reactor 17 flow into the fractionation zone 29. This column, or series of columns, is designed and operated to separate the various compounds in the entering stream by boiling point. The lightest materials comprising some hydrogen and $C_1$–$C_4$ hydrocarbons are removed overhead through line 30. The remainder of the hydrocarbons are divided into a naphtha boiling range product stream removed via line 31, a diesel fuel boiling range product removed via line 32 and a recycle stream removed via line 5. In addition a small drag stream of very high boiling compounds can be removed via line 33 if necessary.

One broad embodiment of the invention may be characterized as a hydrocarbon conversion process which comprises the steps of: contacting a hydrocarbonaceous feed stream and hydrogen with a hydrocracking catalyst in a hydrocracking zone at conditions which effect a reduction in the average molecular weight of the feed stream and the production of a hydrocracking zone effluent stream comprising unconverted feed hydrocarbons, distillate product hydrocarbons, hydrogen, normally gaseous hydrocarbons and hydrogen sulfide; cooling the entire hydrocracking zone effluent stream by indirect heat exchange against at least a portion of the feed stream; contacting the hydrocracking zone effluent stream with a hydrotreating catalyst in a post treat reactor at conditions which effect the hydrogenation of naphtha boiling range hydrocarbons and the production of a post treat reactor effluent stream; cooling the post treat reactor effluent stream by indirect heat exchange against process streams circulating in the process; and recovering products comprising naphtha, jet fuel and diesel fuel boiling range hydrocarbons from the post treat reactor effluent stream.

The product distribution of the subject process is set by the feed composition and the conversion rate and selectivity of the hydrocracking catalyst at the chosen operating conditions. The subject process is especially useful in the production of middle distillate fractions boiling in the range of about 300°–700° F. (149°–371° C.) as determined by the appropriate ASTM test procedure. These are recovered by fractionating the liquids recovered from the effluent of the reaction zone. The term "middle distillate" is intended to include the diesel, jet fuel and kerosene boiling range fractions. The terms "kerosene" and "jet fuel boiling point range" are intended to refer to about 300°–450° F. (149°–232° C.) and diesel boiling range is intended to refer to hydrocarbon boiling points of about 338° - about 640° F. (282°–540° C.). The gasoline or naphtha fraction is normally considered to be the $C_5$ to 400° F. (204° C.) endpoint fraction of available hydrocarbons. The boiling point ranges of the various product fractions recovered in any particular refinery will vary with such factors as the characteristics of the crude oil source, the refinery's local markets, product prices, etc. Reference is made to ASTM standards D-975 and D-3699-83 for further details on kerosene and diesel fuel properties and to D-1655 for aviation turbine feed.

Hydrocracking conditions employed in the subject process are those customarily employed in the art for hydrocracking. Hydrocracking reaction temperatures are in the broad range of 400° to 1200° F. (204°–649° C.), preferably between 600° and 950° F. (316°–510° C.). Reaction pressures are preferably between about 1000 and about 3000 psi (13,780–24,130 kPa). A temperature above about 316° C. and a total pressure above about 8270 kPa (1200 psi) are highly preferred. Contact times usually correspond to liquid hourly space velocities (LHSV) in the range of about 0.1 $hr^{-1}$ to 15 $hr^{-1}$, preferably between about 0.2 and 3 $hr^{-1}$. Hydrogen circulation rates are in the range of 1,000 to 50,000 standard cubic feet (scf) per barrel of charge (178–8,888 std. $m^3/m^3$), preferably between 2,000 and 30,000 scf per barrel of charge (355–5,333 std. $m^3/m^3$).

The post treating reactor, located downstream of the hydrocracking reactor, is operated at a temperature about 30 to about 200, preferably 100–200, Fahrenheit degrees cooler than the effluent of the hydrocracking reactor and at a L. H. S. V. of about 2.0 to 15 $hr^{-1}$. The operating pressure is set by the pressure of the effluent of the hydrocracking zone, which also controls the feed stream hydrogen content and hydrogen to hydrocarbon ratio in the post treating reactor.

At least one high pressure separation vessel is normally present between the outlet of the hydrocracking reactor and the inlet to the product fractionation zone. A bed of hydrotreating located in one or more of these vessels, such as in the high pressure separator, could function as the post treating reactor of the subject invention if it is at the appropriate temperature. However, it has been determined that these vessels often do not operate at the desired or optimum temperature for the hydrotreating reaction. The primary function of these vessels is to perform a specific separation and a change in their operating conditions to facilitate hydrotreating may be undesirable. In addition the use of a separate reaction vessel provides more flexibility in operation and design.

The subject process employs at least two different catalysts: a hydrocracking catalyst and a hydrotreating catalyst. The hydrocracking catalyst, preferably comprising a Y-zeolite, is used in the hydrocracking zone with the effluent of this zone then being upgraded in the post treating reactor using the hydrotreating catalyst. Suitable catalysts for use in all reaction zones of this process are available commercially from a number of vendors including UOP, Haldor-Topsoe and Criterion Catalyst Company. The catalyst in the post treating reactor may be the same as in any hydrotreating reactor located upstream of the hydrocracking reactor. However, it will preferably be selected for hydrotreating a lighter, lower metals feed material.

It is preferred that the hydrocracking catalyst comprises between 1 wt. % and 90 wt. % Y zeolite, preferably between 10 wt. % and 80 wt. %. The zeolitic catalyst composition should also comprise a porous refractory inorganic oxide support (matrix) which may form between about 10 and 99 wt. %, and preferably between 20 and 90 wt. % of the support of the finished catalyst composite. The matrix may comprise any known refractory inorganic oxide such as alumina, magnesia, silica, titania, zirconia, silica-alumina and the like and preferably comprises a combination thereof such as alumina and silica-alumina. The most preferred matrix comprises a mixture of silica-alumina and alumina wherein the silica-alumina comprises between 15 and 85 wt. % of said matrix. It is also preferred that the support comprises from about 5 wt. % to about 45 wt. % alumina.

A Y zeolite has the essential X-ray powder diffraction pattern set forth in U.S. Pat. No. 3,130,007. The as synthesized zeolite may be modified by techniques known in the art which provide a desired form of the zeolite. Thus, modification techniques such as hydrothermal treatment at increased temperatures, calcination, washing with aqueous acidic solutions, ammonia exchange, impregnation, or reaction with an acidity strength inhibiting specie, and any known combination of these are contemplated. A Y-type zeolite preferred for use in the present invention possesses a unit cell size between about 24.20 Angstroms and 24.45 Angstroms. Preferably, the zeolite unit cell size will be in the range of about 24.20 to 24.40 Angstroms and most preferably about 24.30 to 24.38 Angstroms. The Y zeolite is preferably dealuminated and has a framework $SiO_2$:$Al_2O_3$ ratio greater than 6, most preferably between 6 and 25. The Y zeolites produced by UOP of Des Plaines, Ill. under the trademarks Y-82, Y-84, LZ-10 and LZ-20 are suitable zeolitic starting materials. These zeolites have been described in the patent literature. It is contemplated that other zeolites, such as Beta, Omega, L or ZSM-5, could be employed as the zeolitic component of the hydrocracking catalyst in place of or in addition to the preferred Y zeolite.

The silica-alumina component of the hydrocracking or hydrotreating catalyst may be produced by any of the numerous techniques which are well described in the prior art relating thereto. Such techniques include the acid-treating of a natural clay or sand, co-precipitation or successive precipitation from hydrosols. These techniques are frequently coupled with one or more activating treatments including hot oil aging, steaming, drying, oxidizing, reducing, calcining, etc. The pore structure of the support or carrier commonly defined in terms of surface area, pore diameter and pore volume, may be developed to specified limits by any suitable means including aging a hydrosol and/or hydrogel under controlled acidic or basic conditions at ambient or elevated temperature.

An alumina component of the catalysts may be any of the various hydrous aluminum oxides or alumina gels such as alpha-alumina monohydrate of the boehmite structure, alpha-alumina trihydrate of the gibbsite structure, beta-alumina trihydrate of the bayerite structure, and the like. One preferred alumina is referred to as Ziegler alumina and has been characterized in U.S. Pat. Nos. 3,852,190 and 4,012,313 as a by-product from a Ziegler higher alcohol synthesis reaction as described in Ziegler's U.S. Pat. No. 2,892,858. A second preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina.

The finished catalysts for utilization in the subject process should have a surface area of about 200 to 700 square meters per gram, a pore diameter of about 20 to about 300 Angstroms, a pore volume of about 0.10 to about 0.80 milliliters per gram, and apparent bulk density within the range of from about 0.50 to about 0.90 gram/cc. Surface areas above 350 $m^2/g$ are greatly preferred.

The composition and physical characteristics of the catalysts such as shape and surface area are not considered to be limiting upon the utilization of the present invention. Both catalysts may, for example, exist in the form of pills, pellets, granules, broken fragments, spheres, or various special shapes such as trilobal extrudates, disposed as a fixed bed within a reaction zone. Alternatively, the hydrocracking catalyst may be prepared in a suitable form for use in moving bed reaction zones in which the hydrocarbon charge stock and catalyst are passed either in countercurrent flow or in co-current flow. Another alternative is the use of a fluidized or ebulated bed hydrocracking reactor in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed through the reactor(s) in the liquid or mixed phase, and in either upward or downward flow. The catalyst particles may be prepared by any known method in the art including the well-known oil drop and extrusion methods.

A preferred form for the catalysts used in the subject process is an extrudate. The well-known extrusion method involves mixing the molecular sieve, either before or after adding metallic components, with the binder and a suitable peptizing agent to form a homogeneous dough or thick paste having the correct moisture content to allow for the formation of extrudates with acceptable integrity to withstand further handling and subsequent calcination. Extrudability is determined from an analysis of the moisture content of the dough, with a moisture content in the range of from 30 to 50 wt. % being preferred. The dough then is extruded through a die pierced with multiple holes and the spaghetti-shaped extrudate is cut to form particles in accordance with techniques well known in the art. A multitude of different extrudate shapes are possible, including, but not limited to, cylinders, cloverleaf, dumbbell and symmetrical and asymmetrical polylobates. It is also within the scope of this invention that the uncalcined extrudates may be further shaped to any desired form, such as spheres, by any means known to the art.

A spherical catalyst may be formed by use of the oil dropping technique such as described in U.S. Pat. Nos. 2,620,314; 3,096,295; 3,496,115 and 3,943,070 which are incorporated herein by reference. Preferably, this method involves dropping the mixture of molecular sieve, alumina sol, and gelling agent into an oil bath maintained at elevated temperatures. The droplets of the mixture remain in the oil bath until they set to form hydrogel spheres. The spheres are then continuously withdrawn from the initial oil bath and typically subjected to specific aging treatments in oil and an ammoniacal solution to further improve their physical characteristics. The resulting aged and gelled particles are then washed and dried at a relatively low temperature of about 50°–200° C. and subjected to a calcination procedure at a temperature of about 450°–700° C. for a period of about 1 to about 20 hours. This treatment effects conversion of the hydrogel to the corresponding alumina matrix. The zeolite and silica-alumina must be admixed into the aluminum containing sol prior to the initial dropping step. Other references describing oil dropping techniques for catalyst manufacture include U.S. Pat. Nos. 4,273,735; 4,514,511 and 4,542,113. The production of spherical catalyst particles by different methods is described in U.S. Pat. Nos. 4,514,511; 4,599,321; 4,628,040 and 4,640,807.

Hydrogenation components may be added to both the hydrocracking catalyst and the hydrotreating and post treating catalysts before or during the forming of the catalyst particles, but the hydrogenation components of the hydrocracking catalyst are preferably composited with the formed support by impregnation after the zeolite and inorganic oxide support materials have been formed to the desired shape, dried and calcined. Impregnation of the metal hydrogenation component into the catalyst particles may be carried out in any manner known in the art including evaporative, dip and vacuum impregnation techniques. In general, the dried and calcined particles are contacted with one or more solutions which contain the desired hydrogenation components in dissolved form. After a suitable contact time, the composite particles are dried and calcined to produce finished catalyst particles. Further information on techniques for the preparation of hydrocracking catalysts may be obtained by reference to U.S. Pat. Nos. 3,929,672; 4,422,959; 4,576,711; 4,661,239; 4,686,030; and, 4,695,368 which are incorporated herein by reference.

Hydrogenation components contemplated for use in the two catalysts are those catalytically active components selected from the Group VIB and Group VIII metals and their compounds. References herein to Groups of the Periodic Table are to the traditionally American form as reproduced in the fourth edition of *Chemical Engineer's Handbook,* J. H. Perry editor, McGraw-Hill, 1963. Generally, the amount of hydrogenation components present in the final catalyst composition is small compared to the quantity of the other above-mentioned support components. The Group VIII component generally comprises about 0.1 to about 30% by weight, preferably about 1 to about 20% by weight of the final catalytic composite calculated on an elemental basis. The Group VIB component of the hydrocracking catalyst comprises about 0.05 to about 30% by weight, preferably about 0.5 to about 20% by weight of the final catalytic composite calculated on an elemental basis. The total amount of Group VIII metal and Group VIB metal in the finished catalyst in the hydrocracking catalyst is preferably less than 21 wt. percent. The hydrogenation components contemplated for inclusion in the hydrocracking catalysts include one or more metals chosen from the group consisting of molybdenum, tungsten, chromium, iron, cobalt, nickel, platinum, palladium, iridium, osmium, rhodium, ruthenium and mixtures thereof. The hydrogenation components will most likely be present in the oxide form after calcination in air and may be converted to the sulfide form if desired by contact at elevated temperatures with a reducing atmosphere comprising hydrogen sulfide, a mercaptan or other sulfur containing compound. When desired, a phosphorus component may also be incorporated into the hydrotreating catalyst. Usually phosphorus is present in the catalyst in the range of 1 to 30 wt. % and preferably 3 to 15 wt. % calculated as $P_2O_5$.

In the subject process the post treating reaction zone is preferably operated at hydrocarbon-conversion conditions including a pressure of about 1500 to 3000 psig and a temperature of about 400° to 650° F. (preferably 500°–575° F.). Liquid hourly space velocities may range from about 10 to 20 $hr^{-1}$ but preferably are above 12 $hr^{-1}$. Hydrogen-to-hydrocarbon molar ratios of from about 0.1 to 10 and preferably sufficient to have a hydrogen circulation rate of 4,000 to 10,000 S.C.F.B. (standard cubic feet/barrel feed) should be maintained in the post treating reaction zone. The post treat reactor is much smaller (e.g. one-tenth to one twentieth) than the upstream hydrocracking or hydrotreating reactors.

One embodiment of the invention may accordingly be characterized as a two-step hydrocracking process which produces upgraded middle distillate products and which comprises the steps of contacting a hydrocarbonaceous feedstream having a 10 percent boiling point above about 260° C. (500° F.) and a hydrogen rich gas stream with a hydrocracking catalyst in a hydrocracking zone at conditions which effect a reduction in the average molecular weight of the feed stream and the production of a hydrocracking zone effluent stream comprising naphtha and higher boiling point range hydrocarbons, unconverted hydrocarbons, hydrogen, light hydrocarbons and hydrogen sulfide; cooling the entire hydrocracking zone effluent stream by indirect heat exchange against the hydrocarbonaceous feed stream and against the hydrogen rich gas stream; contacting the hydrocracking zone effluent stream with a hydrotreating catalyst in a post treat reactor at conditions which effect a reduction in the mercaptan content of the naphtha boiling range hydrocarbons, the hydrogenation of jet fuel boiling range aromatic hydrocarbons, the hydrogenation of naphtha boiling range hydrocarbons and the production of a post treat reactor effluent stream; cooling the entire post treat reactor effluent stream by indirect heat exchange against the hydrogen rich gas stream and against the hydrocarbonaceous feed stream; passing the post treat reactor effluent stream into a vapor-liquid separation zone, and producing a liquid phase process stream; and, recovering products comprising naphtha and diesel fuel boiling range hydrocarbons and a recycle stream comprising hydrocarbons

EXAMPLE

This example is based upon the engineering calculations performed in the design stage of a commercial (naphtha product) hydrocracking unit using established techniques shown to accurately predict process operations. The flow of this commercial unit largely resembles that shown in the Drawing.

The feedstock is a straight run gas oil having a boiling point range of about 388 (IBP) to about 932° F. (90%). The gas oil had an API of 22.09 and contained about 962 wt. ppm nitrogen and 1.54 wt. % sulfur. The gas oil is contacted with a fixed bed of a commercial hydrocracking catalyst containing a dealuminated Y zeolite with alumina and silica-alumina in the support. The feedstock is passed into a hydrotreating reactor operated at a liquid hourly space velocity of about 0.7 $hr^{-1}$, a recycle gas rate of 4000 SCF/B (fresh feed) and a start of run outlet temperature of about 720° F. The effluent of the hydrotreating reactor is passed directly into the hydrocracking reactor and contacted with the hydrocracking catalyst. The hydrocracking catalyst contains nickel and tungsten on a support containing alumina and silica-alumina and is maintained at a (separator) pressure of 10515 kPa (1525 psig) and a start of run outlet temperature of 723° F. The hydrocracking reactor is operated at a liquid hourly space velocity of approximately of 1.5 $hr^{-1}$ with a hydrogen circulation rate of 2500 SCFB (combined feed). The projected end of run temperature is approximately 775° F.

The effluent of the hydrocracking reactor is cooled to approximately 692° F. by indirect heat exchange against a portion of the feed stream. It is then further cooled against the recycle stream and the recycle hydrogen stream which cools it to about 623° F. The total effluent of the hydrocracking zone is passed into the post treating or hydrotreating reactor at this temperature and a pressure of 11410 kPa (1655 psig). There is essentially no temperature rise in this reactor. The effluent of the post treating reactor is cooled to about 503° F. by exchange against the feed stream, then to about 475° F. by exchange against a stream of debutanizer bottoms and finally to about 422° F. by exchange against the hydrogen recycle gas stream. The resultant mixed phase stream is passed into a high pressure hot separator operated at this temperature. Further removal of heat for use in the debutanizer reduces the temperature of the vapor removed from the high pressure hot separator to approximately 379° F. The vapor is then cooled to about 110° F. by indirect cooling by ambient air and cooling water and the resultant mixed phase stream is passed into the high pressure cold separator operated at about 10530 kPa (1527 psig). The vapor removed from the high pressure cold separator is divided into the recycle hydrogen stream, a vent gas stream and makeup gas to another processing unit. The liquid streams from both high pressure separators is passed into a low pressure hot separator operated at about 417° F. and 2165 kPa (314 psig) The liquid recovered from this separator is passed into a debutanizer column and the debutanized liquid is passed into a product recovery column.

What is claimed:

1. A hydrocarbon conversion process which comprises:

a) contacting a hydrocarbonaceous feed stream and hydrogen with a hydrocracking catalyst in a hydrocracking zone at conditions which effect a reduction in the average molecular weight of the feed stream and the production of a hydrocracking zone effluent stream comprising unconverted feed hydrocarbons, distillate product hydrocarbons, hydrogen, normally gaseous hydrocarbons and hydrogen sulfide;

b) cooling the entire hydrocracking zone effluent stream by indirect heat exchange against at least a portion of the feed stream;

c) contacting the hydrocracking zone effluent stream with a hydrotreating catalyst in a post treat reactor at conditions including a temperature of from about 500°–550° F. and a L.H.S.V. above 10 $hr^{-1}$ which effect the hydrogenation of naphtha boiling range hydrocarbons and the production of a post treat reactor effluent stream;

d) cooling the post treat reactor effluent stream by indirect heat exchange against process streams circulating in the process; and, e) recovering products comprising naphtha, jet fuel and diesel fuel boiling range hydrocarbons from the post treat reactor effluent stream.

2. The process of claim 1 wherein the hydrotreated reaction zone effluent stream is cooled by indirect heat exchange against a recycle hydrogen gas stream.

3. The process of claim 1 wherein a recycle stream comprising unconverted hydrocarbons is recovered from the post treat reactor effluent stream and passed into the hydrocracking zone.

4. The process of claim 1 wherein the hydrocracking zone effluent stream is cooled by 30 to 200 Fahrenheit degrees prior to contact with the hydrotreating catalyst in the post treat reactor.

5. A hydrocarbon conversion process which comprises:

a) contacting a hydrocarbonaceous feed stream having a 10 percent boiling point above about 260° C. (500° F.) and a hydrogen rich gas stream with a hydrotreating catalyst in a bulk hydrotreating zone operated at an L.H.S.V. less than 3.0 $hr^{-1}$ and then contacting the effluent of the hydrotreating zone with a hydrocracking catalyst in a hydrocracking zone at conditions which include a temperature between 600° and 950° F. and an L.H.S.V. of about 0.2 to 3 $hr^{-1}$ and which effect a reduction in the average molecular weight of the feed stream and the production of a hydrocracking zone effluent stream comprising unconverted feed hydrocarbons, naphtha boiling point range hydrocarbons, hydrogen, light hydrocarbons and hydrogen sulfide;

b) cooling the entire hydrocracking zone effluent stream by indirect heat exchange against the hydrocarbonaceous feed stream and against the hydrogen rich gas stream;

c) contacting the hydrocracking zone effluent stream with a hydrotreating catalyst in a post treat reactor at conditions which include a temperature of 500°–575° F. and an L.H.S.V. of 10–20 $hr^{-1}$ and which effect the hydrogenation of jet fuel boiling range aromatic hydrocarbons, the hydrogenation of naphtha boiling range hydrocarbons and the production of a post treat reactor effluent stream;

d) cooling the entire post treat reactor effluent stream by indirect heat exchange against the hydrogen rich gas stream and against the hydrocarbonaceous feed stream;

e) passing the post treat reactor effluent stream into a vapor-liquid separation zone, and producing a liquid phase process stream; and, recovering products comprising naphtha and diesel fuel boiling range hydrocarbons and a recycle stream comprising hydrocarbons boiling over about 400° C. from the liquid phase process stream.

6. The process of claim 5 wherein the vapor-liquid separation zone is a high pressure hot separator.

7. The process of claim 6 wherein a first vapor-phase process stream recovered from the vapor-liquid separation zone is cooled and partially condensed by indirect heat exchange prior to passage into a high pressure cold separator.

8. The process of claim 7 wherein a second vapor-phase process stream is recovered from the high pressure cold separator and at least partially recycled to the hydrocracking zone as said hydrogen rich gas stream.

* * * * *